US010415188B1

(12) United States Patent
Knauf et al.

(10) Patent No.: US 10,415,188 B1
(45) Date of Patent: Sep. 17, 2019

(54) DISPOSABLE CUPS MADE FORM RECYCLED FIBER

(71) Applicant: GPCP IP Holdings LLC, Atlanta, GA (US)

(72) Inventors: Gary Harold Knauf, Bear Creek, WI (US); Joseph R. Pounder, Greenville, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 85 days.

(21) Appl. No.: 15/634,361

(22) Filed: Jun. 27, 2017

Related U.S. Application Data

(60) Provisional application No. 62/355,795, filed on Jun. 28, 2016.

(51) Int. Cl.

| | |
|---|---|
| ***D21H 11/14*** | (2006.01) |
| ***D21H 27/00*** | (2006.01) |
| ***B65D 81/00*** | (2006.01) |
| ***B65D 81/38*** | (2006.01) |

(52) U.S. Cl.
CPC ..... *D21H 11/14* (2013.01); *B65D 81/3865* (2013.01); *D21H 27/00* (2013.01); *B65D 2081/008* (2013.01)

(58) Field of Classification Search
CPC ..... D21H 27/10; D21H 27/30; D21H 11/14; D21H 19/10; B65D 1/265; B65D 81/3865; B65D 2081/008; Y10T 428/1303; Y10T 428/1352; Y10T 428/273
See application file for complete search history.

(56) References Cited

U.S. PATENT DOCUMENTS

| | | | | |
|---|---|---|---|---|
| 6,379,497 | B1 * | 4/2002 | Sandstrom | B65D 1/265 162/123 |
| 6,740,373 | B1 * | 5/2004 | Swoboda | B32B 29/06 229/5.81 |
| 7,510,098 | B2 | 3/2009 | Hartjes et al. | |
| 7,513,386 | B2 | 4/2009 | Hartjes et al. | |
| 7,841,974 | B2 | 11/2010 | Hartjes et al. | |
| 8,622,232 | B2 | 1/2014 | Pounder et al. | |
| 8,801,899 | B1 * | 8/2014 | Reed | D21H 17/29 162/123 |
| 9,168,714 | B2 | 10/2015 | Fike et al. | |
| 2003/0114071 | A1 * | 6/2003 | Everhart | D04H 1/49 442/414 |
| 2003/0152724 | A1 * | 8/2003 | Swoboda | B65D 65/42 428/34.2 |
| 2004/0213930 | A1 * | 10/2004 | Halabisky | B65D 81/3874 428/34.2 |

(Continued)

FOREIGN PATENT DOCUMENTS

WO WO-2017065800 A1 * 4/2017 ..... D21H 11/00

*Primary Examiner* — Jose A Fortuna

(57) ABSTRACT

A paperboard, sidewall, and disposable cup made from about 70 wt % to about 100 wt % of recycled fiber. The paperboard can include about 70 wt % to about 100 wt % of recycled fiber, based on the total weight of the fiber. The paperboard can have a board thickness of about 14 mil to about 20 mil, an apparent density of less than about 11.5 lbs/3,000 $ft^2$/mil, a CD Taber Stiffness of about 50 g*cm or more, and a MD/CD Taber Stiffness ratio of 1.0 to 3.0, and can be used to make recycled cups having sufficient strength and rigidity properties that rival cups made from virgin fibers.

29 Claims, 5 Drawing Sheets

(56) References Cited

U.S. PATENT DOCUMENTS

| | | | | |
|---|---|---|---|---|
| 2004/0213961 | A1* | 10/2004 | Halabisky | B32B 29/00 428/156 |
| 2004/0213978 | A1* | 10/2004 | Halabisky | D21H 15/02 428/292.1 |
| 2007/0215301 | A1* | 9/2007 | Bunker | D21H 21/18 162/146 |
| 2007/0256805 | A1* | 11/2007 | Reed | D21H 21/54 162/164.1 |
| 2008/0029236 | A1* | 2/2008 | Williams | D21H 13/24 162/146 |
| 2008/0060774 | A1* | 3/2008 | Zuraw | C09D 101/00 162/135 |
| 2009/0047511 | A1* | 2/2009 | Tilton | B32B 5/24 428/337 |
| 2009/0142528 | A1* | 6/2009 | Tilton | B32B 27/12 428/35.7 |
| 2011/0031305 | A1* | 2/2011 | Pounder | B65D 81/3869 229/403 |
| 2011/0067832 | A1* | 3/2011 | Xia | D21H 21/36 162/161 |
| 2012/0255696 | A1* | 10/2012 | Ballinger | D21H 17/36 162/164.1 |
| 2012/0312869 | A1* | 12/2012 | Fike | B65D 81/3869 229/400 |
| 2016/0348318 | A1* | 12/2016 | Koenig | D21H 19/80 |
| 2018/0112427 | A1* | 4/2018 | Bryan | E04G 23/0281 |
| 2018/0134472 | A1* | 5/2018 | Shi | D21H 19/84 |
| 2018/0142418 | A1* | 5/2018 | Sundholm | D21H 23/48 |
| 2018/0313039 | A1* | 11/2018 | Tuszkiewicz | D21H 11/00 |

* cited by examiner

DISPOSABLE CUPS MADE FORM RECYCLED FIBER

BACKGROUND OF THE INVENTION

Field of the Invention

Embodiments described generally relate to fiber based blanks for making disposable consumer products. More particularly, such embodiments relate to paperboard blanks containing a large amount of recycled fibers for making disposable products and methods for making and using same.

Description of the Related Art

Paperboard is used to make a wide variety of paper products, such as plates, bowls, and cups, and used to package a wide variety of materials. Recycled materials are widely used in the manufacture of paper products and paper packaging. This can be primarily due to the fact that virgin fibers are typically more expensive than fibers obtained from recycled materials. In addition, many consumers make purchasing decisions based upon whether a product is made from recycled materials or provided in a package made from recycled materials.

Paperboard made from recycled fiber is not as strong and stiff as paperboard made from virgin fiber of a similar thickness. Recycled paperboard strength can be increased by increasing its thickness, or caliper. Increasing the thickness of a paperboard, however, increases the cost of the paperboard to a point where recycled fibers are no longer more economical than virgin fibers. And increasing the thickness of a paperboard is sometimes not an option due to equipment limitations.

There is a need, therefore, for improved paperboard and products made therefrom that exhibit strength and rigidity that are comparable to those made of the same or similar thickness from virgin fiber.

SUMMARY OF THE INVENTION

A paperboard, sidewall, and disposable cups made from about 70 wt % to about 100 wt % of recycled fiber, based on the total weight of the fiber, are provided. The paperboard can have a board thickness of about 14 mil to about 20 mil, an apparent density of less than about 11.5 lbs/3,000 $ft^2$/mil, a CD Taber Stiffness of about 50 g*cm or more, and a MD/CD Taber Stiffness ratio of 1.0 to 3.0.

In one aspect, the sidewall can include a substrate made from about 75 wt % to about 100 wt % of recycled fiber, based on the total weight of the fiber. The substrate can have a thickness of about 14 mil to about 20 mil; an apparent density of less than about 11.5 lbs/3,000 $ft^2$/mil; a CD Taber Stiffness of about 50 g*cm or more; and a MD/CD Taber Stiffness ratio of 1.0 to 3.0. A layer of low density polyethylene can be at least partially disposed on a first side of the substrate.

In one aspect, the disposable cup can include a sidewall comprising a substrate made of about 75 wt % to about 100 wt % of recycled fiber, based on the total weight of the fiber. The substrate can have a thickness of about 16 mil to about 20 mil; an apparent density of less than about 11.5 lbs/3,000 ft2/mil; a CD Taber Stiffness of about 50 g*cm or more; and a MD/CD Taber Stiffness ratio of 1.0 to 3.0. A layer of low density polyethylene can be at least partially disposed on a first side of the substrate. The cup can further have a bottom panel comprising about 75 wt % to about 100 wt % of recycled fiber, based on the total weight of the bottom panel, to form a cup having a rigidity greater than about 0.6 lbf/0.25 inch deflection.

BRIEF DESCRIPTION OF THE DRAWINGS

So that the manner in which the above recited features of the present invention can be understood in detail, a more particular description of the invention, briefly summarized above, can be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
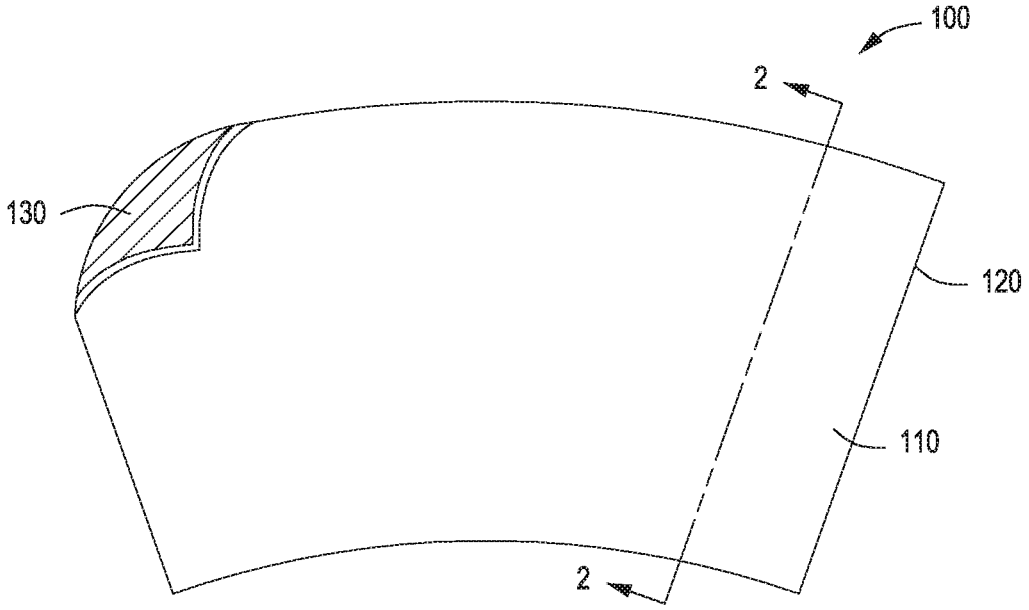
FIG. 1 depicts a schematic view of an illustrative paperboard blank for making a disposable cup.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

It has been surprisingly discovered that a paperboard can be made from a large amount of recycled fibers to have a MD/CD Taber Stiffness ratio of 1.0 to 3.0, and such paperboard having an economically-viable thickness can be used to make disposable consumer products. The term "recycled fiber" as used herein refers to fiber that has been recovered by one or more recycling processes. Recycled fiber can be obtained from recycled material. Such fibers can include those generated by post-consumer recycling processes and pre-consumer recycling processes.

The paperboard can include recycled fiber in amount of at least 70 wt % based on the total weight of the fiber in the paperboard. The amount of the recycled fiber can be at least 80 wt %, 85 wt %, 88 wt %, 90 wt %, 93 wt %, 95 wt %, 97 wt %, or 99 wt %. In a preferable embodiment, the paperboard is made entirely (100 wt %) of recycled fibers, meaning there are no virgin fibers. In certain embodiments where the paperboard is not made entirely of recycled fibers, the balance can include varying amounts of virgin fibers, additives, fillers, or the like. Some of which are described in more detail below.

The recycled fiber can be substantially derived from old corrugated containers ("OCC"). In certain embodiments, the recycled fiber can be at least 25 wt % of fibers recycled or otherwise recovered from old corrugated containers. The recycled fiber can be at least 35 wt %, at least 45 wt %, at least 50 wt %, at least 60 wt %, at least 70 wt %, at least 80 wt %, at least 90 wt %, at least 96 wt %, or at least 99 wt % of fibers recycled or otherwise recovered from old corrugated containers. The recycled fiber also can be 100 wt % of fibers recycled or otherwise recovered from old corrugated containers.

The recycled fiber can be substantially derived from pre-consumer products. In certain embodiments, the recycled fiber can be at least 25 wt % of pre-consumer fiber. For example, the recycled fiber can be at least 35 wt %, at least 45 wt %, at least 50 wt %, at least 60 wt %, at least 70 wt %, at least 80 wt %, at least 90 wt %, at least 96 wt %, or at least 99 wt % of pre-consumer fiber. Pre-consumer fiber refers to fiber obtained from any paper or paperboard scrap generated, for example, during a packaging manufacturing process. Pre-consumer fiber can include fiber obtained from packaging materials that have been manufactured but are not suitable for use in packaging materials for quality or other reasons. Pre-consumer fiber also can include fiber obtained from the recycling of a waste stream in a forming process.

The recycled fiber can be substantially derived from post-consumer products. In certain embodiments, the recycled fiber can be at least 25 wt % of post-consumer fiber. For example, the recycled fiber can be at least 35 wt %, at least 45 wt %, at least 50 wt %, at least 60 wt %, at least 70 wt %, at least 75 wt %, at least 80 wt %, at least 85 wt %, at least 90 wt %, or 100% of post-consumer fiber. Post-consumer fibers refer to fibers obtained from paper or paperboard products that have been discarded for disposal or recovery after having completed their intended uses. Post-consumer fiber can be obtained from the sorting of materials from a consumer or manufacturer waste stream.

The paperboard can include less than 30 wt % of virgin fiber based on the total weight of the fiber in the paperboard. More preferably, the paperboard includes less than 20 wt %, less than 15 wt %, less than 10 wt %, less than 8 wt %, less than 5 wt %, or less than 2 wt % of virgin fiber. In any embodiment above or elsewhere herein, the paperboard can have no virgin fiber and can be made entirely of recycled fiber. Virgin fibers refer to fibers that have never before been used to prepare paper or paperboard, and are derived directly from trees or plant-based sources.

The paperboard can have any suitable thickness or caliper. For example, the paperboard can have a board caliper of about 14 mil to about 22 mil. The paperboard also can have a board caliper of about 15 mil to about 20 mil, or about 16 mil to about 20 mil. The board caliper can also range from a low of about 14, 15, or 16 to a high of about 17, 18, 19, or 20 mils.

The paperboard can have a basis weight of about 163 grams to about 550 grams per square meter (about 100 pounds to about 339 pounds per 3,000 square feet) or about 195 grams to about 500 grams per square meter (about 120 pounds to about 306 pounds per 3,000 $ft^2$). The basis weight of the paperboard can be a low of about 195 grams, about 210 grams, about 225 grams, about 250 grams, or about 275 grams to a high of about 325 grams, about 350 grams, about 375 grams, about 400 grams, about 425 grams, or about 450 grams per square meter.

The paperboard can have a board density or apparent density of less than about 15 lbsper 3,000 square feet per mil (lbs/3,000 $ft^2$/mil). For example, the apparent density of the paperboard can be less than about 13 lbs/3,000 $ft^2$/mil; less than about 12 lbs/3,000 $ft^2$/mil; less than about 11.5 lbs/3,000 $ft^2$/mil; less than about 11 lbs/3,000 $ft^2$/mil; or less than about 10 lbs/3,000 $ft^2$/mil. The apparent density of the paperboard can also range from a low of about 8.0, 8.5 or 9.0 to a high of about 11, 13, or 15 lbs/3,000 $ft^2$/mil.

The paperboard can have a cross direction ("CD") Taber Stiffness of about 40 g*cm or more. For example, the CD Taber Stiffness can be about 45 g*cm or more, about 50 g*cm or more, about 55 g*cm or more, about 65 g*cm or more, about 70 g*cm or more, or about 75 g*cm or more. The CD Taber Stiffness also can range from a low of about 50, 55, or 60 to a high of about 75, 100, or 125 g*cm The paperboard can have a machine direction ("MD") Taber Stiffness of about 150 g*cm or more. For example, the MD Taber Stiffness can be about 100 g*cm or more, about 120 g*cm or more, about 130 g*cm or more, about 140 g*cm or more, about 150 g*cm or more, or about 170 g*cm or more. The MD Taber Stiffness also can range from a low of about 100, 125, or 150 to a high of about 175, 200, 225 g*cm.

The paperboard can have a MD/CD Taber Stiffness ratio of 1.0 to 3.0. The MD/CD Taber Stiffness ratio can also be 1.5 to 2.8. The MD/CD Taber Stiffness ratio can also be 1.5 to 2.5, or 1.6 to 2.5, 1.5 to 2.2, or 1.5 to 2.0.

The paperboard can have a moisture content of less than 10%. The moisture content if preferably less than 9%, less than 8%, less than 7%, less than 6%, less than 5%, or less than 4%. The moisture content can range from a low of about 3%, 4%, 5% to a high of about 5.5%, 6.5%, or 7.5%.

The paperboard can be at least partially lined or coated on one or both sides thereof with non-paperboard or non-paper materials. For example, the paperboard can be at least partially coated with one or more polyolefins, one or more clays, one or more waxes, one or more other suitable oil resistant materials and/or water proof materials, oxygen barrier materials, or metal, e.g. aluminum. When the paperboard is lined or coated, the paperboard provides a base layer or substrate that one more coatings or liners are to be disposed thereon.

Suitable coatings can include at least one polymer selected from the group consisting of butylene polymer, ethylene polymer, high density polyethylene (HDPE) polymer, medium density polyethylene (MDPE) polymer, low density polyethylene (LDPE) polymer, propylene (PP) polymer, isotactic polypropylene (iPP) polymer, high crystallinity polypropylene (HCPP) polymer, ethylene-propylene (EP) copolymers, ethylene-propylene-butylene (EPB) terpolymers, propylene-butylene (PB) copolymer, an ethylene elastomer, ethylene-based plastomer, propylene elastomer and combinations or blends thereof. Other suitable outer or top coatings can include acrylic polymers, such as ethylene acrylic acid (EAA), ethylene methyl acrylate copolymers (EMA), polyvinylidene chloride (PVdC), poly(vinyl)alcohol (PVOH) and EVOH.

Any number of coatings can be used. Each coating be applied as a single layer to one or both sides of the paperboard substrate. Each coating also can be applied or combined with one or more other coatings to form a multilayer coating on one or both sides of the paperboard substrate. Each coating can be applied directly on the paperboard substrate or directly one more other coating layers or partial layers thereof.

Any suitable method for applying coatings can be used. For example, the coatings can be applied by an emulsion coating technique. The coatings can also be applied by extrusion coating, co-extrusion coating and/or lamination.

Each coating can be clear, white, or pigmented to have any other color. The thickness of each coating layer can vary. For example, each coating layer can have a thickness ranging from about 5 to 100 microns, or about 5 to 50 microns, or about 5 to 25 microns. The resulting coated paperboard can have any suitable thickness. For example, the resulting coated paperboard can have a thickness of about 14 mil to about 22 mil; about 15 mil to about 20 mil; or about 16 mil to about 20 mil. The board thickness can also range from a low of about 14, 15, or 16 to a high of about 17, 18, 19, or 20 mils.

Each of the pulp stocks can comprise additives to improve the processing of the pulp stock and/or improve the end properties of the paperboard made therefrom. Generally, materials that can be used to improve the processing of the pulp stocks include, but are not limited to, slimicides (used to control microbial growth), pH controls, retention aids (used to improve retention of fines and fillers) and drainage aids (used to improve water removal at the wet end). Materials that can be used to improve appearance and/or durability of the paperboard can include, but are not limited to, fillers (e.g. clay or talc to help improve optical and surface properties), starch (to augment dry strength properties of finished paperboard), wet strength resins (to improve tear properties of paperboard in damp and humid conditions), sizing agents (such as rosins to control penetration of liquids into finished paperboard) and fluorocarbons (to provide a grease barrier in finished paperboard). Suitable additives to the pulp stock and/or the paperboard can include one or more opacifying agents, pigments or colorants, and can include iron oxide, carbon black, aluminum, titanium dioxide ($TiO_2$), calcium carbonate ($CaCO_3$), polybutylene terephthalate (PBT), talc, beta nucleating agents, and combinations thereof. One or more process aids can be applied to an inner or outer surface of the paperboard. For example, mineral oil, mineral oil lubricants, or silicone lubricants can be added as cup machine process aids. The process aid can be applied to only a portion of the paperboard surface, such as in an area that is curled or folded.

The paperboard can be prepared using a conventional pressure former or a Fourdrinier-type forming device. With a pressure former, a pulp stock is introduced onto a cylinder by a pressurized explosion chamber and a forming zone. Water from the pulp stock flows through a mesh surface on the cylinder, pressing the fibers onto the surface of the cylinder as the cylinder rotates, forming a ply. As the cylinder rotates, the ply can be continuously transferred to a moving felt on a soft rubber couch roll. Water removal can be assisted by using a vacuum to pull the water from the pulp stock.

With a Fourdrinier-type forming device, in general terms, a finely woven belt, usually made from synthetic monofilament, or sometimes wire, travels between two large rollers. The first roller is the breast roller and is located below a headbox. As the pulp stock is applied to the woven belt, the fibers lay against the belt and water pours through the mesh. The second roller is the couch roller and is located at the end of the woven belt. The couch roller is sometimes hollow and perforated. Water removal can be assisted by using a suction box attached to the second roller to help pull the water from the pulp stock.

The paperboard can be used in any number of consumer products. For example, the paperboard can be used to make consumer products in the form of a box, cup, tray, plate, bowl, tray, platter, can, tube, bottle or other containers. Such products can be used for both consumable food and beverages as well as non-consumable product packaging for same as well as other consumer items. Examples of suitable food and beverages include, but are not limited to beverages, coffee, tea, water, soda, alcoholic beverages, sweets, chocolate, sugar, pastries, biscuits, butter, cheese, dry coffee, dry tea, cocoa, flour, cereals, ice cream, vegetables, seafood, fresh and semi-preserved foods, pet food and carryout foods. Examples of suitable non-consumable food/beverage include, but are not limited to cosmetics, toiletries, pharmaceuticals, cigarettes, detergents, textiles, toys, games, tools, household appliances, pesticides, fertilizers, hobby items, paper products, cassettes, record sleeves, nails, screws, and auto parts. The terms "paper product," "paper containers," "paperboard products," and "paperboard containers" are intended to be interchangeable.

Figure 2:
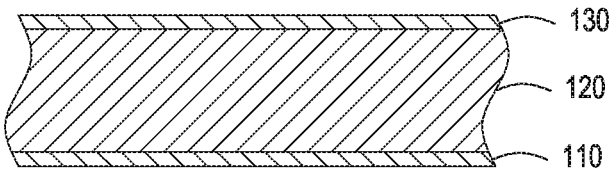
FIG. 2 depicts a schematic cross-sectional view of the paperboard blank depicted in FIG. 1 along line 2-2.

For simplicity and ease of description, the paperboard will be further described with reference to a disposable cup made therefrom. FIG. 1 depicts a schematic view of an illustrative paperboard blank 100 containing at least 70 wt % of recycled fiber, based on the total weight of fiber in the blank, in accordance with one or more embodiments described above, and FIG. 2 depicts a schematic cross-sectional view along line 2-2 of the blank 100 depicted in FIG. 1. Referring to FIGS. 1 and 2, the blank 100 can include a first layer or inner coating 110 at least partially disposed on a first side of the paperboard substrate or base layer 120. The blank 100 can include a second layer or outer coating 130 at least partially disposed on second side of the paperboard substrate or base layer 120. The blank 100 can be formed into a paper cup having a frusto-conical outer sidewall, as depicted in FIG. 3.

Figure 3:
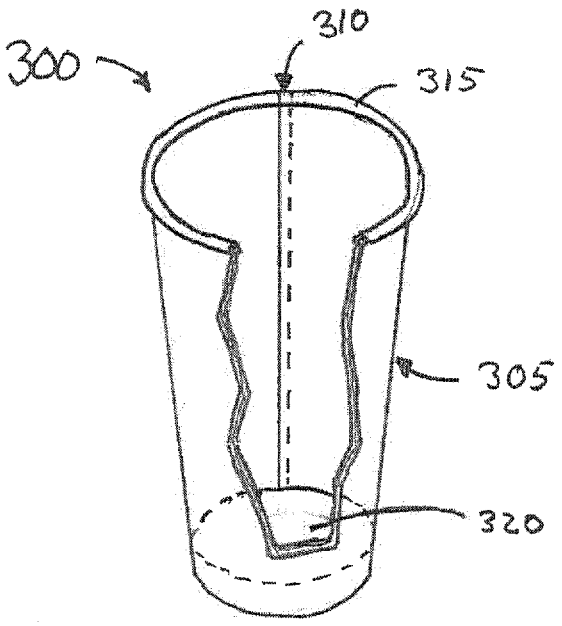
FIG. 3 depicts a partial cut away, perspective view of an illustrative paper cup, according to one or more embodiments described.

FIG. 3 depicts a partial cut away, perspective view of an illustrative paper cup 300 made from the paperboard blank 100. The paper cup 300 can include a sidewall 305, a bottom panel or cup bottom 320, and a brim curl 315. The sides of the blank 100 can be overlapped with one another to form the sidewall 305 and glued or otherwise fixed to one another forming a seam 310. A first or upper edge of the blank 100 can be curled to form the brim 315. The bottom panel 320 can be secured to the sidewall 305 at or adjacent to a second or lower edge of the blank 100. The bottom panel 320 can be made from recycled fibers as the paperboard blank 100. The bottom panel 320 can have the same or substantially the recycled fiber content and weight as the blank 100, and can be cut from the same paperboard. The bottom panel 320 also can be made from a different paper stock having a different recycled fiber content. The bottom panel 320 also can be made from a paper stock that is 100% virgin fiber.

If the paperboard substrate 120 is coated with a polymeric material, e.g., polyethylene, the sidewall 305 can be heat sealed to provide the sealed seam 310. The seam 310 can also be sealed with one or more adhesives. Any suitable adhesive can be used.

A shrinkable film can be disposed on an inner surface of the sidewall 305. Additional details of this embodiment as well as additional details of suitable adhesives for forming the seam 310 or attaching a shrinkable film, as well as suitable cup configurations and methods for making same can be found in U.S. Pat. Nos. 9,168,714; 8,622,232; 7,841,974; 7,510,098; and 7,513,386.

Examples

The foregoing discussion can be further described with reference to the following non-limiting examples. Four paperboards (Ex. 1-4) were prepared, each made from 100% recycled OCC fibers. A paperboard made from 100% virgin fiber was also prepared and provided as the benchmark for comparison (Comparative Example 1). The virgin cupstock paperboard had no binder and no surface sizing, and is commercially available from Georgia Pacific, LL under the grade designation CPD190. Certain physical parameters, including the Taber MD stiffness, CD stiffness, basis weight, and caliper were measured and are reported in Table 1. The Taber MD and CD stiffness values were measured using a Taber Stiffness Tester, consistent with the TAPPI T 489 test method. The paperboard caliber was measured according to the T-411 test method.

A 12 ounce cup was made from Ex 1, 2, and 4, and was measured for rigidity (Lbf per 0.25" deflection). Example 3 was not made into cups but remained a flat stock sample used for testing purposes only.

TABLE 1

Paperboard Comparison

| | Board Machine Type | Basis Weight lb/3000 ft/\2 | Caliper 1 sheet, mils/1 sht | Apparent Density, Lb/3MSF/mil | Taber Stiffness MD, g * cm | Taber Stiffness CD, g * cm | Taber Stiffness GM, g * cm | Taber MD/CD | Stretch MD, % | Stretch CD, % | 12oz Cup Rigidity, Lbf/1/4" Deflection |
|---|---|---|---|---|---|---|---|---|---|---|---|
| Comparative Ex. 1- Virgin PB, Control | Fourdrinier | 196.71 | 17.946 | 11.0 | 235.5 | 116.4 | 165.5 | 2.02 | 1.98 | 4.10 | 1.10 |
| Ex. 1: 100% Recycled Fiber | Fourdrinier | 187.59 | 18.174 | 10.3 | 171.3 | 81.3 | 118.0 | 2.11 | 1.65 | 3.30 | 0.887 |
| Ex. 2: 100% Recycled Fiber | Fourdrinier | 203.49 | 18.820 | 10.8 | 168.5 | 69.8 | 108.4 | 2.42 | 1.80 | 3.58 | 0.608 |
| Ex. 3: 100% Recycled Fiber | Cylinder | 185.29 | 18.866 | 9.8 | 197.2 | 65.8 | 113.9 | 3.00 | 1.47 | 4.78 | N/A |
| Ex. 4: 100% Recycled Fiber | Cylinder | 183.59 | 17.850 | 10.3 | 196.43 | 42.2 | 91.1 | 4.65 | 1.71 | 4.68 | 0.588 |

As seen in Table 1, Examples 1-2 that were made using a Fourdrinier-type forming process provided a paperboard having a MD/CD ratio of 2.11 and 2.42 respectively. These MD/CD ratios were the closest to Comp, Ex. 1 made of 100% virgin fiber. Examples 3-4 made using a cylinder machine type provided a paperboard having a MD/CD ratio of 3.0 and 4.65, respectively.

Figure 4:
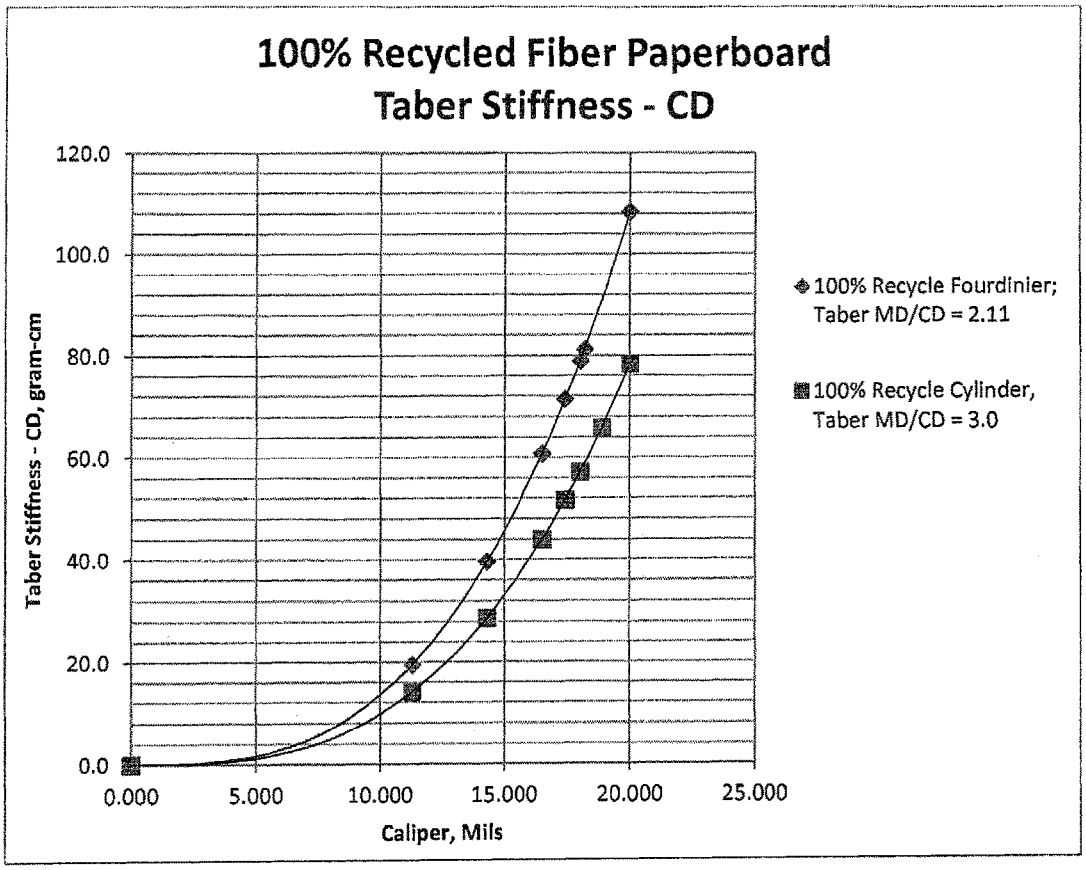
FIG. 4 is a graphical representation showing the relationship between CD Stiffness and caliper of paperboards made using a Fourdinier-type process, as summarized in Table 1 below.
Figure 5:
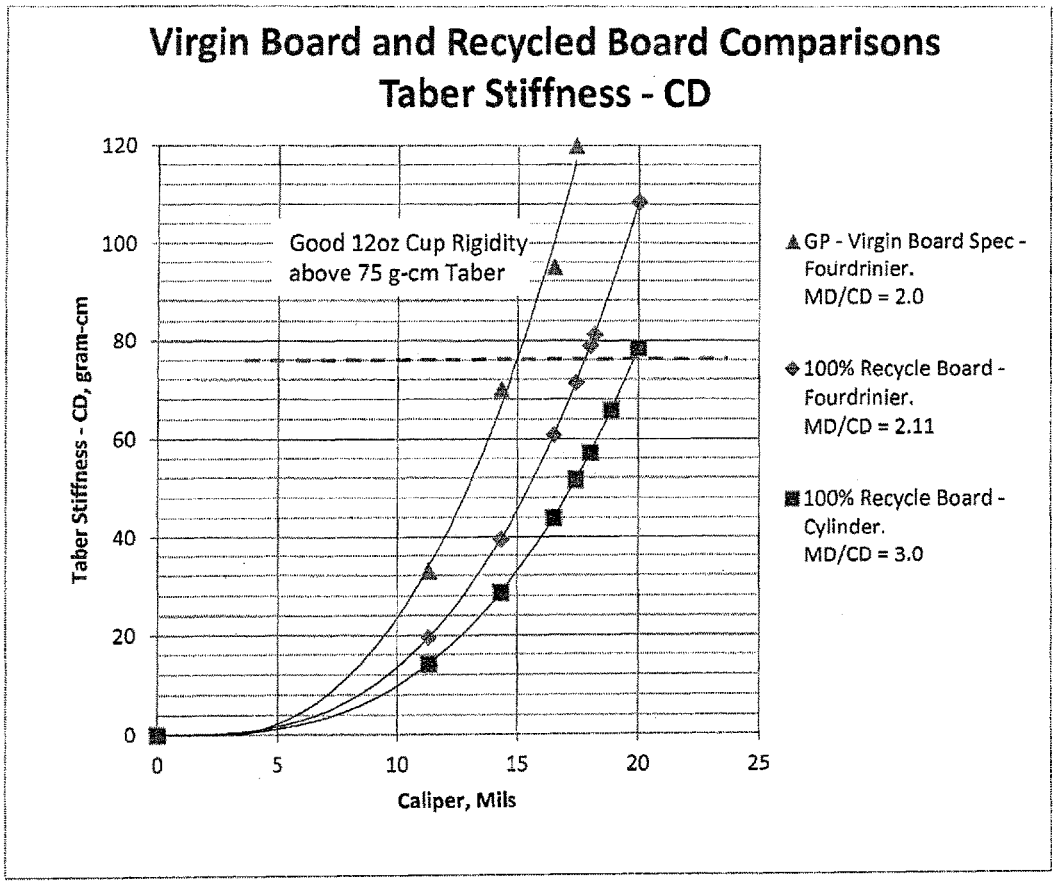
FIG. 5 is a graphical representation showing the relationship between CD Stiffness and caliper of the paperboards reported in Table 1 below.
Figure 6:
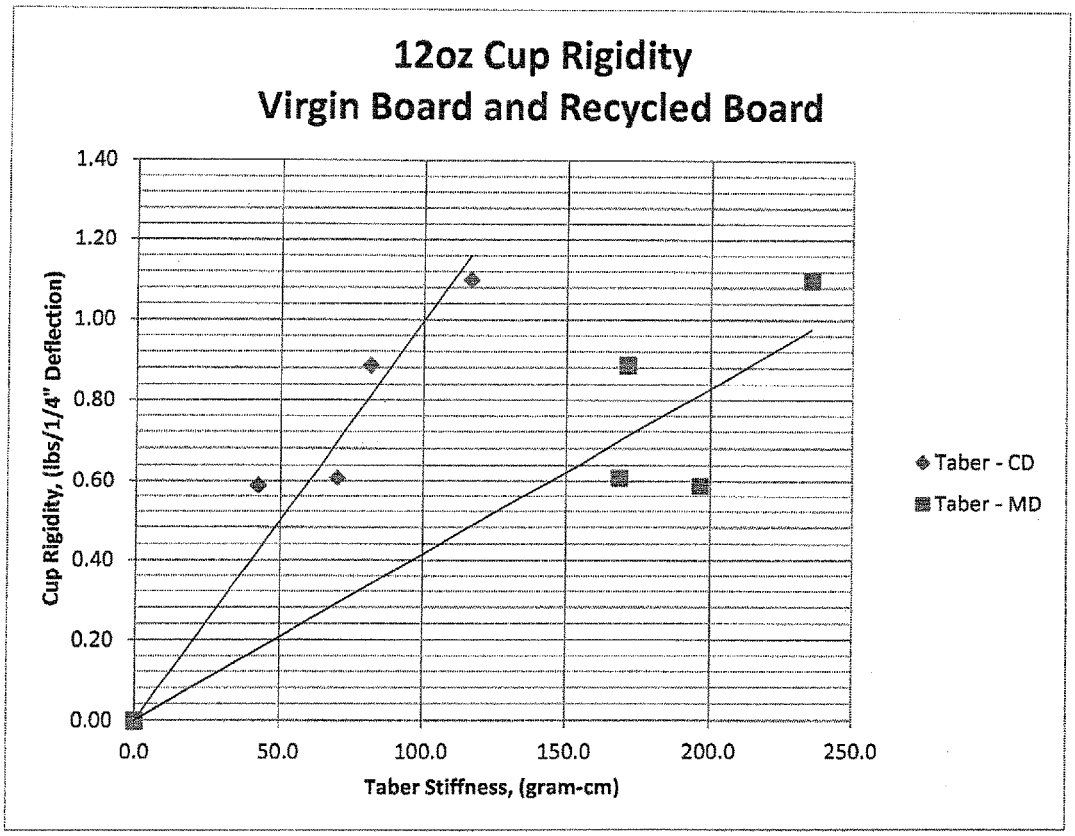
FIG. 6 is a graphical representation showing the relationship between CD Stiffness and cup rigidity made from the paperboards reported in Table 1 below.

It was surprisingly discovered that a MD/CD ratio of 1.0 to 3.0 is essential to providing a paperboard substrate with comparable strength and rigidity properties to paperboards made from 100% virgin fiber of similar thickness, as illustrated in Table 1. Said another way, it was surprising how critical the MD/CD ratio is for cup rigidity. As shown in Table 1, paperboards having a MD/CD ratio within the range of 1.0 to 3.0 could be made using a Fourdrinier-type forming process, but paperboards made of similar recycled fibers made using a cylinder machine type resulted in MD/CD ratios well in excess of 3.0. It was further discovered that a paperboard with a MD/CD of 3 would require more than 20 mil board to make cups having a suitable strength and rigidity to cups made from virgin fiber, as illustrated in FIGS. 4-6.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A paperboard for making disposable consumer products, comprising:

about 70 wt % to about 100 wt % of recycled fiber, based on the total weight of the fiber;

a board thickness of about 14 mil to about 20 mil;

an apparent density of less than about 11.5 lbs/3,000 $ft^2$/mil;

a CD Taber Stiffness of about 50 g*cm or more; and a MD/CD Taber Stiffness ratio of 1.0 to 3.0.

2. The paperboard of claim 1, wherein the recycled fiber is substantially derived from old corrugated containers.

3. The paperboard of claim 1, wherein at least 25% of the recycled fiber is post-consumer recycled fiber.

4. The paperboard of claim 1, wherein the paperboard comprises 75 wt % to 90 wt % of the recycled fiber and less than 25 wt % of virgin fiber.

5. The paperboard of claim 1, wherein the apparent density is less than about 11.0 lbs/3,000 $ft^2$/mil.

6. The paperboard of claim 1, wherein the apparent density is less than about 10.5 lbs/3,000 $ft^2$/mil.

7. The paperboard of claim 1, wherein the cross direction (CD) Taber Stiffness is 75 g-cm or more.

8. The paperboard of claim 1, wherein the MD/CD Taber Stiffness ratio is about 1.0 to about 2.5.

9. The paperboard of claim 1, further comprising a surface coating at least partially disposed on a first side of the paperboard, wherein the surface coating comprises clay, starch, sizing, or a mixture thereof.

10. A sidewall for making a disposable cup made from recycled fibers, comprising:

a substrate comprising about 75 wt % to about 100 wt % of recycled fiber, based on the total weight of the fiber, wherein the substrate comprises:

a thickness of about 14 mil to about 20 mil;

an apparent density of less than about 11.5 lbs/3,000 $ft^2$/mil;

a CD Taber Stiffness of about 50 g*cm or more; and a MD/CD Taber Stiffness ratio of 1.0 to 3.0; and a layer of low density polyethylene at least partially disposed on a first side of the substrate.

11. The sidewall of claim 10, wherein the recycled fiber is substantially derived from old corrugated containers.

12. The sidewall of claim 10, wherein at least 25% of the recycled fiber is post-consumer recycled fiber.

13. The sidewall of claim 10, wherein the substrate comprises 75 wt % to 90 wt % of the recycled fiber and less than 25 wt % of virgin fiber.

14. The sidewall of claim 10, wherein the apparent density is less than about 10.5 lbs/3,000 $ft^2$/mil.

15. The sidewall of claim 10, wherein the cross direction (CD) Taber Stiffness is 75 g-cm or more, and the MD/CD Taber Stiffness ratio is about 1.0 to about 2.5.

16. The sidewall of claim 10, further comprising a layer of oil resistant material at least partially disposed on a second side of the substrate.

17. The sidewall of claim 16, wherein the oil resistant material comprises low density polyethylene (LDPE) or an acrylic emulsion polymer.

18. A disposable cup, comprising:

a sidewall comprising:

a substrate layer comprising about 75 wt % to about 100 wt % of recycled fiber, based on the total weight of the fiber, wherein the substrate layer has a thickness of about 16 mil to about 20 mil; an apparent density of less than about 11.5 lbs/3,000 $ft^2$/mil; a CD Taber Stiffness of about 50 g*cm or more; and a MD/CD Taber Stiffness ratio of 1.0 to 3.0; and a layer of low density polyethylene at least partially disposed on a first side of the substrate; and a bottom panel comprising about 75 wt % to about 100 wt % of recycled fiber, based on the total weight of the bottom panel, wherein the cup has a rigidity greater than about 0.6 lbf/0.25 inch deflection.

19. The disposable cup of claim 18, wherein the rigidity is about 0.8 lbf/0.25 inch or more.

20. The disposable cup of claim 18, wherein the rigidity is about 1.0 lbf/0.25 inch or more.

21. The disposable cup of claim 18, wherein the substrate comprises 75 wt % to 90 wt % of the recycled fiber and less than 25 wt % of virgin fiber, the recycled fiber being substantially derived from old corrugated containers, and wherein the cross direction (CD) Taber Stiffness is 75 g-cm or more, the MD/CD Taber Stiffness ratio is about 1.0 to about 2.5, and the rigidity is about 1.0 lbf/0.25 inch or more.

22. The disposable cup of claim 18, further comprising a layer of oil resistant material at least partially disposed on a second side of the substrate, wherein the oil resistant material comprises low density polyethylene (LDPE).

23. The disposable cup of claim 18, further comprising a layer of oil resistant material at least partially disposed on a second side of the substrate, wherein the oil resistant material comprises an acrylic emulsion polymer.

24. A disposable cup, comprising:

a sidewall comprising:

a substrate layer comprising about 75 wt % to about 100 wt % of recycled fiber, based on the total weight of the fiber, wherein the substrate layer has a thickness of about 16 mil to about 20 mil; an apparent density of less than about 11.5 lbs/3,000 $ft^2$/mil; a CD Taber Stiffness of about 50 g*cm or more; and a MD/CD Taber Stiffness ratio of 1.0 to 3.0; and a layer of low density polyethylene at least partially disposed on a first side of the substrate;

a layer of oil resistant material at least partially disposed on a second side of the substrate, wherein the oil resistant material comprises low density polyethylene (LDPE) or an acrylic emulsion polymer; and a bottom panel comprising about 75 wt % to about 100 wt % of recycled fiber, based on the total weight of the bottom panel, wherein the cup has a rigidity greater than about 0.6 lbf/0.25 inch deflection.

25. The disposable cup of claim 24, wherein the rigidity is about 0.8 lbf/0.25 inch or more.

26. The disposable cup of claim 24, wherein the rigidity is about 1.0 lbf/0.25 inch or more.

27. The disposable cup of claim 24, wherein the substrate comprises 75 wt % to 90 wt % of the recycled fiber and less than 25 wt % of virgin fiber, the recycled fiber being substantially derived from old corrugated containers, and wherein the cross direction (CD) Taber Stiffness is 75 g-cm or more, the MD/CD Taber Stiffness ratio is about 1.0 to about 2.5, and the rigidity is about 1.0 lbf/0.25 inch or more.

28. The disposable cup of claim 24, wherein the oil resistant material comprises low density polyethylene (LDPE).

29. The disposable cup of claim 24, wherein the oil resistant material comprises an acrylic emulsion polymer.

* * * * *